US008646132B2

(12) United States Patent
Nguyen

(10) Patent No.: US 8,646,132 B2
(45) Date of Patent: Feb. 11, 2014

(54) BED WITH LINEN CHANGING MEANS

(76) Inventor: Vu L. U. Nguyen, Vaughan (CA)

( * ) Notice: Subject to any disclaimer, the term of this patent is extended or adjusted under 35 U.S.C. 154(b) by 62 days.

(21) Appl. No.: 12/976,561

(22) Filed: Dec. 22, 2010

(65) Prior Publication Data

US 2012/0159709 A1 Jun. 28, 2012

(51) Int. Cl.
*A47C 21/02* (2006.01)

(52) U.S. Cl.
USPC ..... 5/488; 5/611

(58) Field of Classification Search
USPC ..... 5/8, 9.1, 181–185, 11, 611, 488
See application file for complete search history.

(56) References Cited

U.S. PATENT DOCUMENTS

| | | | | | |
|---|---|---|---|---|---|
| 726,472 | A * | 4/1903 | Smith | 5/600 |
| 1,089,208 | A * | 3/1914 | Gosnell et al. | 5/600 |
| 1,459,112 | A * | 6/1923 | Mehl | 5/88.1 |
| 2,112,702 | A * | 3/1938 | Loibl | 5/600 |
| 2,870,460 | A * | 1/1959 | Sanford | 5/11 |
| 3,945,063 | A * | 3/1976 | Matsuura | 5/611 |
| 5,233,712 | A * | 8/1993 | Jurus et al. | 5/613 |
| 5,333,334 | A * | 8/1994 | Kassai | 5/85.1 |
| 5,699,566 | A * | 12/1997 | Chuang | 5/613 |
| 5,704,083 | A * | 1/1998 | Nerg | 5/600 |
| 5,737,782 | A | 4/1998 | Matsuura et al. | |
| 5,839,134 | A * | 11/1998 | Matsuura et al. | 5/504.1 |
| 5,943,715 | A | 8/1999 | Matsuura et al. | |
| 7,818,831 | B2 * | 10/2010 | Mahdjoubi | 5/81.1 R |
| 2007/0028381 | A1 * | 2/2007 | Palay et al. | 5/81.1 R |

* cited by examiner

*Primary Examiner* — William Kelleher
*Assistant Examiner* — Richard G Davis
(74) *Attorney, Agent, or Firm* — Montgomery Patent & Design; Robert C. Montgomery

(57) ABSTRACT

A bed with linen changing means comprises features that allow the mattress linen to be changed without requiring an occupant to leave the bed. The bed frame provides a matrix of parallel slats which support the occupant while the mattress is lowered and extended for linen changing. The mattress comprises a plurality of parallel horizontal mattress sections spaced apart allowing corresponding insertion between the slats until said slats are recessed within the mattress and a user is able to lie comfortably upon raised portions of the mattress. The mattress is supported by a mobile frame apparatus being vertically adjustable via a manually-operated crank and gear assembly such that a caretaker may lower the mattress while the bed occupant rests upon the slats, providing easy access to the mattress for purposes of changing bed linens. The mattress is then raised back into place to support the occupant.

14 Claims, 11 Drawing Sheets

BED WITH LINEN CHANGING MEANS

RELATED APPLICATIONS

FIELD OF THE INVENTION

The present invention relates generally to a bed assembly for a medical patient, and in particular, to a bed assembly for a medical patient including a bed linen changing means which does not require movement on the part of the patient.

BACKGROUND OF THE INVENTION

Patients such as elderly patients or those afflicted by a disease or injury which limits their ability to move face many problems during a treatment process. One (1) particular problem associated with paralysis and numbness is that such patients experience constant pressure from their body upon their resting surface due to their inability to move, which can result in sores forming upon exposed portions of their skin.

Regularly changing of sheets or mattresses can help a patient to avoid infections, particularly skin infections, and to prevent the formation of ulcers. In many cases, the patient must either move themselves or is moved away from the bed by a caretaker to allow the sheets to be changed. This can be difficult for a caretaker who must attempt to roll or lift a patient and can aggravate the condition that placed that patient in this situation in the first place.

There have been many solutions to change the posture of a bedridden patient to accommodate various needs, such as utilizing a toilet. Many known solutions involve transferring the patient from a lying position to a sitting posture. However, this too involves some risk associated with the movement of the patient.

In many cases, such movement is further inhibited by the presence of medical devices which are affixed to various parts of the patient's body to facilitate tracking and treatment.

Various attempts have been made to provide patient beds which facilitate movement of a patient without the patient having to leave the bed. Examples of these attempts can be seen by reference to several U.S. patents including U.S. Pat. Nos. 2,112,702; 5,699,566; 5,704,083; 5,737,782; 5,839,134; and 5,943,715.

While these devices fulfill their respective, particular objectives, each of these references suffer from one (1) or more of the aforementioned disadvantages. Many such apparatuses are uncomfortable for a patient during use. Also, many such apparatuses include a movable portion which is difficult to access or which is not well adapted for use with bed linens. Furthermore, many such apparatuses include motorized portions or otherwise expensive constructions which are unnecessary due to the infrequency with which they must be utilized. In addition, many such apparatuses require a degree of movement on the part of a patient which is undesirable. Accordingly, there exists a need for a bed linen changing means without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for an economical patient bed which allows a caretaker to quickly and easily change bed linens without disturbing the patient. Thus, the object of the present invention is to solve the aforementioned disadvantages and provide for this need.

To achieve the above objectives, it is an object of the present invention to provide a bed which allows a linen sheet to be applied to a mattress assembly without having the bed occupant vacate the apparatus. The apparatus provides a tubular-framed bed structure further comprising an intermediate mobile frame structure containing the mattress assembly which can be lowered away from an occupant using a lifting mechanism.

Another object of the present invention is to include common bed structural features including an upper bed frame assembly, a foot board frame assembly, a head board frame assembly, and a lower bed frame assembly.

Yet still another object of the present invention is to keep the occupant supported in place upon a stationary matrix of support members when the mattress is lowered to change the linens. The support members comprise a plurality of equally spaced rigid rectangular members which span across a top surface between upper side rail frame members of the upper bed frame assembly. After changing, the mattress assembly is slid under the occupant and raised to support the occupant.

Yet still another object of the present invention is to provide comfort to the occupant when supported upon the support members by comprising each support member of a rounded top edge portion.

Yet still another object of the present invention is to allow insertion of the mattress assembly through the support members to provide comfortable support to the occupant during periods of non-use by comprising the mattress assembly of a plurality of equally spaced mattress sections which correspondingly insert through and interweave between the support members when raised. The mattress assembly is supported upon the mobile frame assembly which further comprises dimensions slightly smaller than the upper and lower bed frame assemblies to enable the mobile frame assembly to fit between the foot board frame assembly and the head board frame assembly.

Yet still another object of the present invention is to provide a firm support to the mattress sections. Each mattress section includes an upper padding portion and a rigid lower mattress slat portion which supports the upper padding portion and provides attachment to side rails portions of the mobile frame assembly.

Yet still another object of the present invention is to slidingly support a pair of mobile frame support members of the mobile frame assembly upon a corresponding pair of lifting mechanism rail portions attached to the foot board frame assembly and the head board frame assembly. The mobile frame assembly can then be slid horizontally along the lift mechanism rail portions to motion the mobile frame assembly outwardly to allow for changing of linens. The mobile frame assembly includes a pair of mobile frame casters located at lower outside corners to enable rolling along a ground surface.

Yet still another object of the present invention is to allow the caregiver to manually adjust the height of the mobile frame assembly and mattress assembly by operating a hand crank which is connected to a crank shaft portion of the lifting mechanism. The lifting mechanism comprises the crank shaft, a gear housing, and output shaft, and a plurality of mechanical linkages.

Yet still another object of the present invention is to provide mechanical advantage to enable the caregiver to easily operate the lifting mechanism. The gear housing encloses a pinion and ring gears which provide a conventional torque multiplying gear ratio to reduce the required force to be applied by the caregiver to the hand crank.

Yet still another object of the present invention is to provide synchronous motioning of a pair of lifting arm rods and a corresponding pair of lifting arms when the hand crank is motioned in order to apply a scissors-type lifting motion. This in turn raises or lowers the lifting mechanism rails and the supported mobile frame support members to raise or lower the mattress assembly. Motioning of the lifting arms along the lifting mechanism rails is facilitated by rolling end portions which motion laterally in a guided manner.

Yet still another object of the present invention is to provide a method of utilizing the device that provides a unique means of procuring a model of the apparatus being configured in a desired bed size; applying an initial set of sheet linens to the apparatus by lowering the mobile frame assembly, manually extending the mobile frame assembly outwardly, and covering the mattress assembly with sheet linen; tucking the linen in between mattress sections to form a plurality of creases; placing the mobile frame assembly beneath the upper frame assembly; raising the mobile frame assembly using the hand crank until the mattress sections of the mattress assembly interweave with the support member portions of the upper frame assembly; placing an occupant upon the apparatus; utilizing the apparatus in a similar manner as a conventional bed unit; lowering the mobile frame assembly of the occupied apparatus using the hand crank; allowing the occupant to rest temporarily upon the support member portions; extending the mobile frame assembly outwardly to expose the used linen; removing the used linen and covering the mattress assembly with a clean sheet linen; returning the mattress assembly to an in-use position as above; repeating the above steps as needed; and, benefiting from a means to change bed linen without disturbing a bed occupant.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
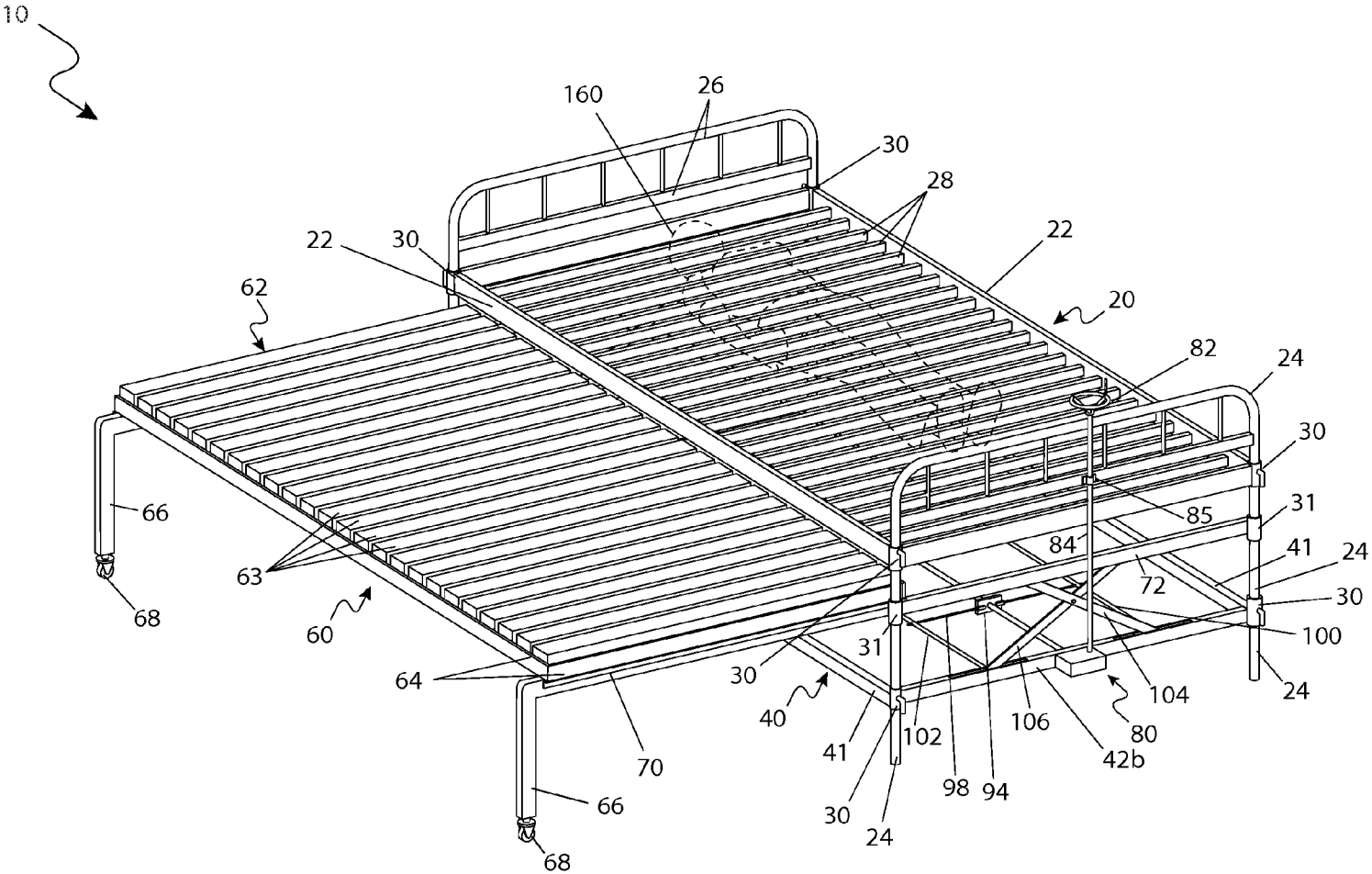
FIG. 1 is a perspective view of a bed with linen changing means 10 depicting a lowered and extended mattress assembly 62 position, according to a preferred embodiment of the present invention.

| | |
|---|---|
| 10 | bed with linen changing means |
| 20 | upper bed frame assembly |
| 22 | upper side rail frame member |
| 24 | foot board frame assembly |
| 26 | head board frame assembly |
| 28 | support member |
| 30 | locking collar |
| 31 | sliding collar |
| 40 | lower bed frame assembly |
| 41 | lower side rail frame member |
| 42a | head board lower frame end rail member |
| 42b | foot board lower frame end rail member |
| 43 | first clearance slot |
| 44 | second clearance slot |
| 60 | mobile frame assembly |
| 62 | mattress assembly |
| 63 | mattress section |
| 64 | mobile frame member |
| 65 | mattress padding |
| 66 | mobile frame leg |
| 67 | mattress slat |
| 68 | mobile frame caster |
| 70 | mobile frame support member |
| 72 | lifting mechanism rail |
| 74 | third clearance slot |
| 80 | lifting mechanism |
| 82 | hand crank |
| 84 | crank shaft |
| 85 | bracket |
| 86 | gear housing |
| 88 | pinion gear |
| 90 | ring gear |
| 92 | output shaft |
| 94 | lift plate |
| 96 | tie rod end |
| 98 | tie rod |
| 100 | first lifting arm rod |
| 102 | second lifting arm rod |
| 104 | first lifting arm |
| 106 | second lifting arm |
| 108 | first pivot pin |
| 111 | second pivot pin |
| 112 | pivot pin aperture |
| 114 | rolling end portion |
| 116 | roller |
| 120 | linen |
| 122 | crease |
| 150 | threaded fastener |
| 152 | nut fastener |
| 160 | occupant |

DETAILED DESCRIPTION OF THE PREFERRED EMBODIMENT

The best mode for carrying out the invention is presented in terms of its preferred embodiment, herein depicted within FIGS. 1 through 11. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a bed (herein described as the "apparatus") 10, having specialized linen changing means comprising particular features which allow a linen sheet 120 to be applied to a mattress assembly 62 without having a bed occupant 160 vacate the bed apparatus 10. The apparatus 10 comprises a conventional tubular-framed bed structure further comprising an intermediate mobile frame structure 60 which contains and supports the mattress assembly 62 which may be lowered away from an occupant 160 via a lifting mechanism 80 and subsequently extended outwardly to access said mattress assembly 62 to change the linens 120. During said lowering of the mattress 62 and changing of linens 120, the occupant is temporarily supported upon a stationary matrix of support members 28. After changing of the linen 120, the mattress assembly 62 is slid under the occupant 160 and raised to once again support the occupant 160 in a normal manner.

Figure 4:
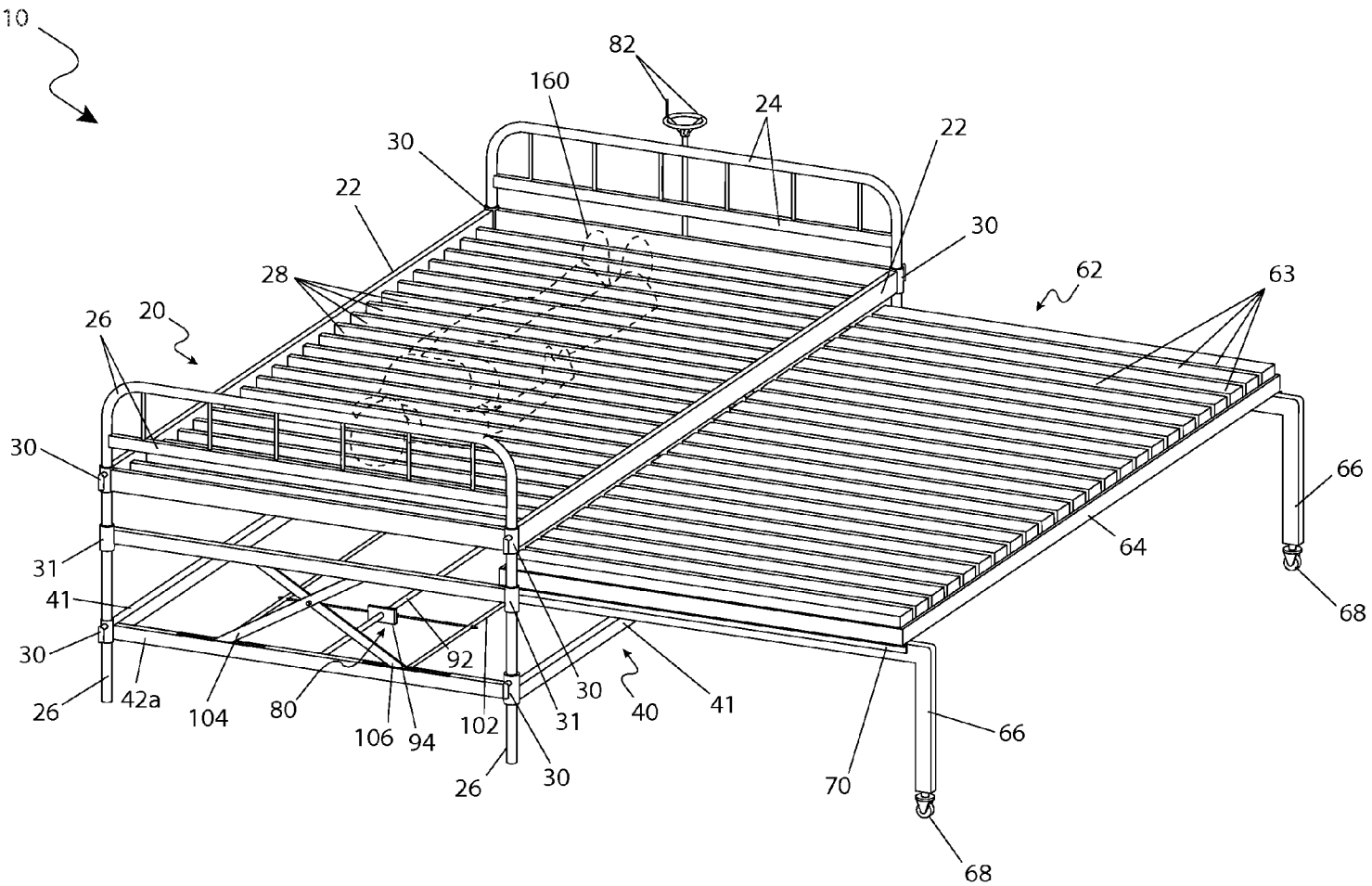
FIG. 4 is a perspective view of a bed with linen changing means 10 depicting a head board frame assembly portion 26, according to a preferred embodiment of the present invention.

Referring now to FIGS. 1 and 4, perspective views of the apparatus 10 depicting a lowered and extended mattress assembly 62 position, according to a preferred embodiment of the present invention, are disclosed. The apparatus 10 comprises a tubular metal frame bed structure, shown here in a conventional twin-size bed configuration; however, other standard bed sizes such as single, double, queen, and the like, may also incorporate the teachings of the invention 10 with equal benefit and as such should not be interpreted as a limiting factor of the apparatus 10. The apparatus 10 comprises an upper bed frame assembly 20, a "U"-shaped foot board frame assembly 24, a "U"-shaped head board frame assembly 26, a lower bed frame assembly 40, and a mobile frame assembly 60. The upper frame assembly 20 comprises a unitary rectangular structure having a plurality of welded or otherwise permanently affixed integral parallel support members 28 which span across a top surface in a coplanar fashion between upper side rail frame members 22. Said support members 28 comprise rigid rectangular members being approximately three-quarters (¾) of an inch thick, approximately three (3) inches in height, and arranged approximately five (5) inches apart, thereby providing a platform which provides sufficient load-bearing strength so as to temporarily support an occupant 160 while the linens 120 are being changed. Furthermore, top edge portions of said support members 28 are envisioned to be rounded to provide extra comfort to an occupant 160 during the linen 120 changing procedure.

The lower bed frame assembly 40 comprises a rectangular unitary frame similar to the upper frame assembly 20 which provides a mounting means to a lifting mechanism 80 at a foot end portion of the apparatus 10. The lifting mechanism 80 provides a means to lower and raise the mobile frame assembly portion 60 which is positioned between said upper frame assembly 20 and lower frame assembly 40 portions. Said mobile frame assembly 60 contains, supports, and provides a means to manipulate the mattress assembly portion 62 of the apparatus 10 (see FIGS. 5 through 10).

The upper 20 and lower 40 frame assemblies provide a vertical height adjusting means being adjustably attached to the foot 24 and head 26 frame assemblies via locking collars 30 which are welded to corner areas of said frame assemblies 20, 40. Said locking collars 30 provide a means to vertically adjustably attach and secure said frame assemblies 20, 40 to the foot board frame assembly 24 and the head board frame assembly 26. Said locking collars 30 comprise hollow cylindrical fittings having inner diameters sized so as to allow sliding insertion of vertical members of the foot 24 and head 26 frame assemblies. Said locking collars 30 further comprise "L"-shaped or equivalent threaded fasteners 150 to clamp and maintain a desired position of said locking collars 30 upon said foot 24 and head 26 frame assembly members.

The mattress assembly comprises a plurality of parallel and equally-spaced mattress sections 63. Adjacent mattress sections 63 are particularly spaced apart allowing insertion of support member portions 28 in between upon raising the mattress assembly 62 to normal in-use position (see FIG. 3). The raising of the mattress assembly 62 allows the mattress sections 63 to interweave with, and extend slightly above the support members 28, to comfortably support the occupant 160. The apparatus 10 allows a means for the occupant 160 to be supported in a normal manner upon a top surface of said mattress assembly 62, and alternately upon the support member portions 28 at times when the mattress assembly 62 is lowered to change the linens 120. When the mattress assembly 62 is in a raised state, the support members 28 lay between the mattress sections 63 and an occupant 160 is able to lie comfortably upon the mattress sections 63.

The mobile frame assembly 60 is illustrated here being positioned in a lowered and extended state enabling easy changing of the linens 120 while the occupant 160 remains lying upon the support member portions 28 of the upper frame assembly 20. The mobile frame assembly 60 comprises a rectangular welded mobile frame structure 64 envisioned being made of similar materials as the upper 20 and lower 40 frame assemblies and having slightly smaller horizontal dimensions with respect to the previously described upper bed frame assembly 20, thereby enabling subjacent insertion beneath said upper bed frame assembly 20 (see FIG. 2). The mobile frame assembly 60 further comprises a pair of welded or otherwise fastened mobile frame support members 70 along foot and a head end portions allowing said mobile frame assembly 60 to slidingly rest upon corresponding lifting mechanism rail portions 72 of the lifting mechanism 80. The mobile frame assembly 60 may be easily slid horizontally while being supported by the lifting mechanism rail portions 72 and being coincidentally rolled along a floor surface via a pair of integral vertical mobile frame legs 66 and a pair of respective mobile frame casters 68 being located at corner positions along a leading edge. Extension of the mobile frame assembly 60 provides exposure of the mattress assembly portion 62 allowing a caregiver to easily change the linens 120.

Figure 2:
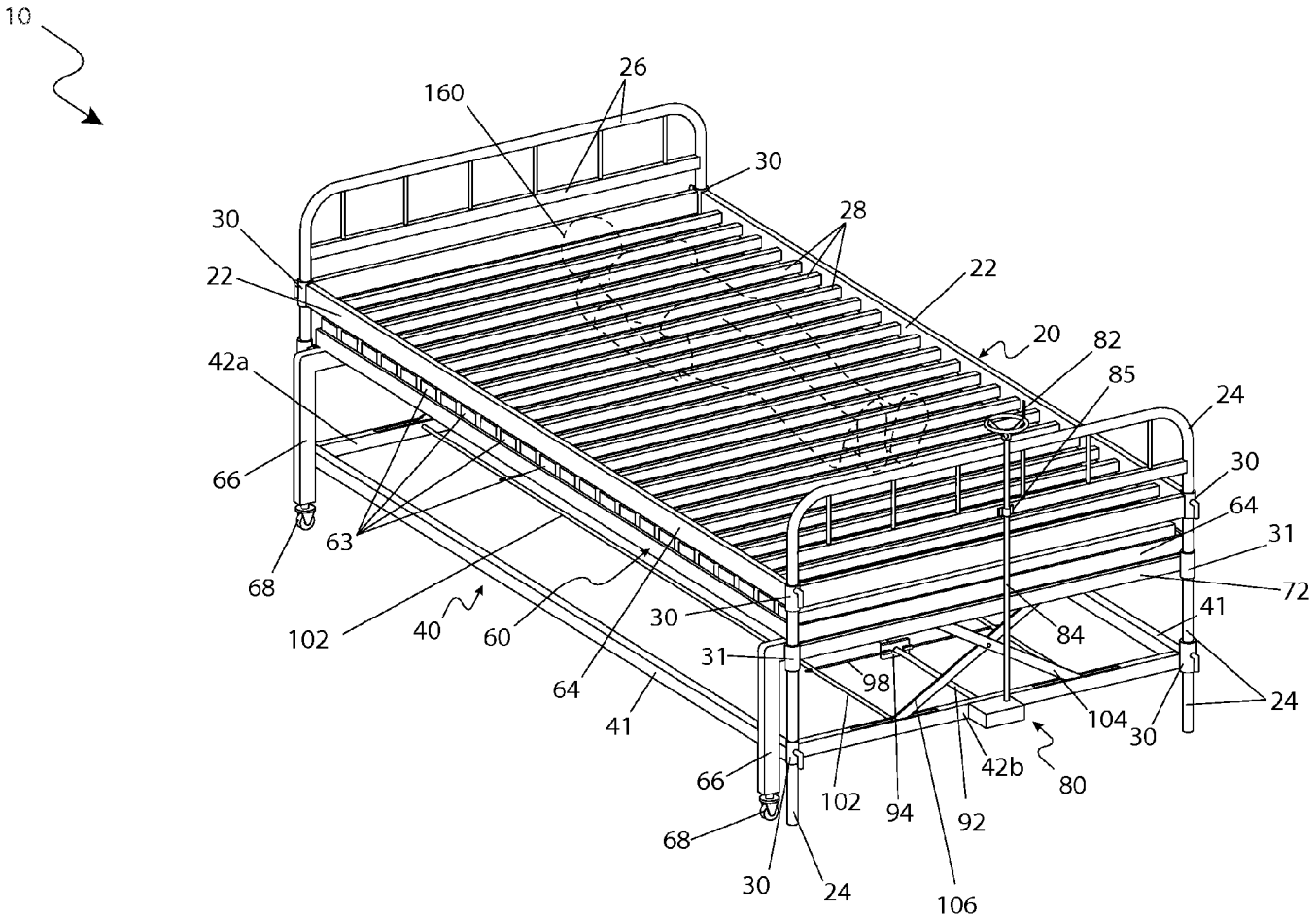
FIG. 2 is a perspective view of the bed with linen changing means 10 depicting subjacent positioning of a mattress assembly 62, according to a preferred embodiment of the present invention.

Referring now to FIG. 2, a perspective view of the apparatus 10 depicting subjacent positioning of the mattress assembly 62, according to a preferred embodiment of the present invention, is disclosed. The legs 66 and caster 68 portions of the mobile frame assembly 60 allow horizontal motioning of the mattress assembly 62 across a floor surface and allow a caregiver to position the mattress assembly 62 beneath the upper frame assembly 20 as seen here. Once properly positioned beneath the upper frame assembly 20, the mattress assembly 62 may be lifted via the lifting mechanism 80 to support the occupant 160 (see FIG. 3).

Figure 3:
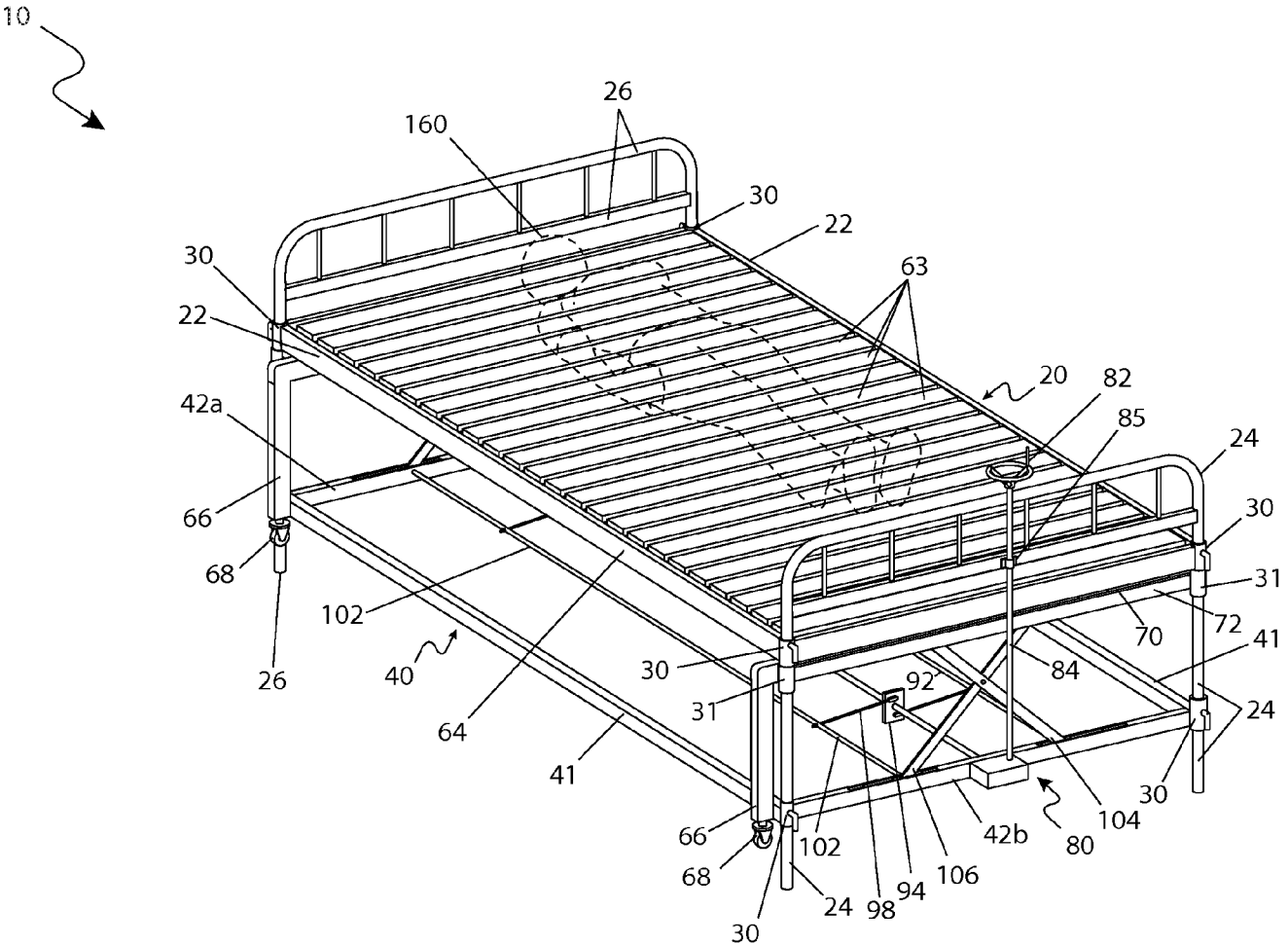
FIG. 3 is a perspective view of the bed with linen changing means 10 depicting a mattress assembly 62 in a raised state, according to a preferred embodiment of the present invention.

Referring now to FIG. 3, a perspective view of the apparatus 10 depicting the mattress assembly 62 in a raised state, according to a preferred embodiment of the present invention, is disclosed. The mattress assembly 62 is to be raised via the lifting mechanism 80, thereby enabling the mattress sections 63 to interweave and extend slightly above the support member portions 28 of the upper frame assembly 20, thereby comfortably supporting the occupant 160 following changing of the linens 120.

The mobile frame assembly 60 and mattress assembly 62 are vertically adjustable by a caregiver via a manually-operated hand crank 82 being operably connected to a crank shaft 84 portion of the lifting mechanism 80 (see FIGS. 5 through 10). The crank shaft 84 is envisioned to be securely affixed to the foot board frame assembly 24 via a common bracket 85 (see FIGS. 5 through 10).

Figure 5:
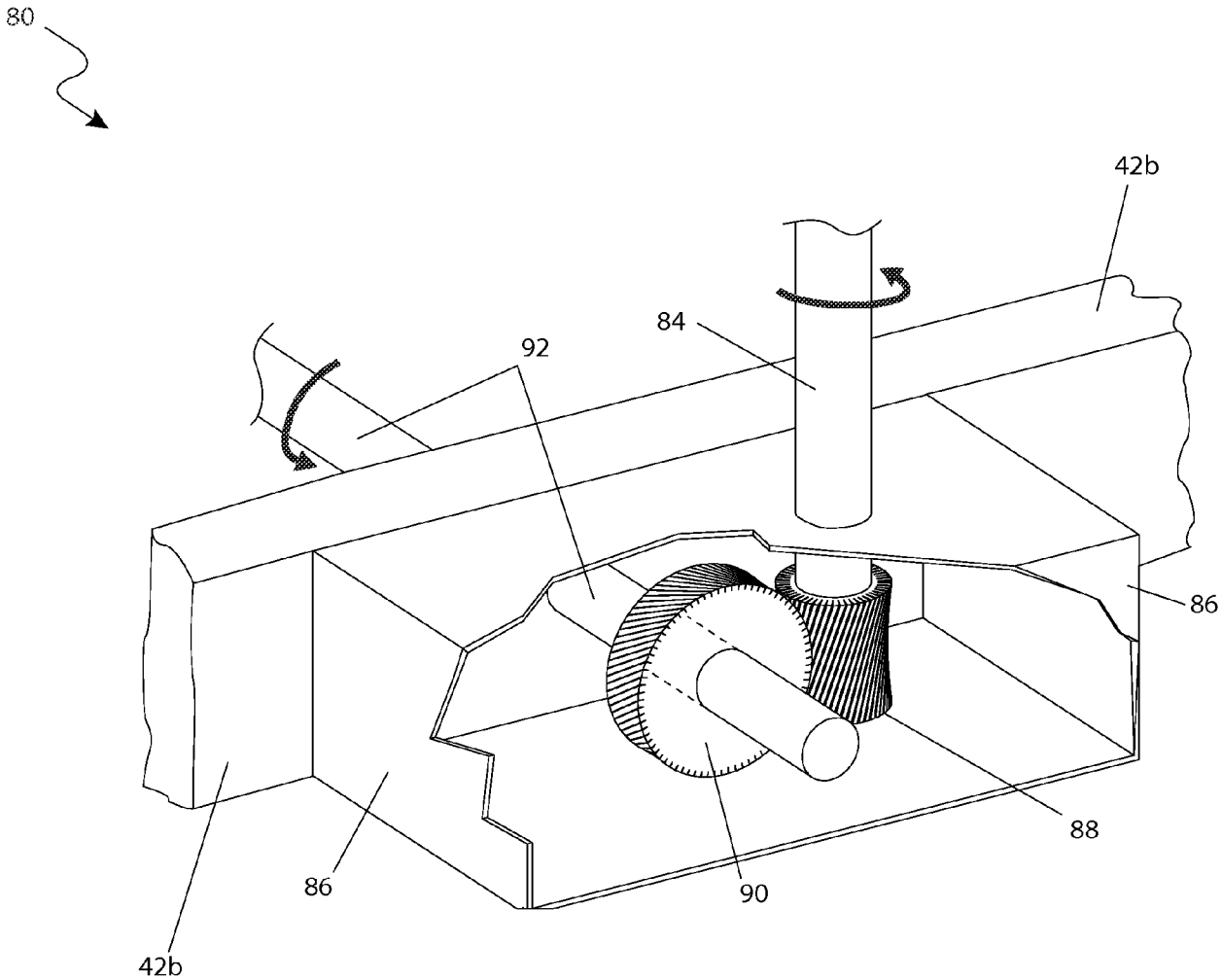
FIG. 5 is a cut-away view of a lifting mechanism 80 portion, according to a preferred embodiment of the present invention.

Referring now to FIG. 5, a cut-away view of the lifting mechanism portion 80, according to a preferred embodiment of the present invention, is disclosed. The lifting mechanism 80 comprises a crank shaft 84, a gear housing 86, an output shaft 92, and additional mechanical linkage necessary to motion the mobile frame assembly 60 and mattress assembly 62 (see FIGS. 6*a* through 10). The gear housing 86 is preferably welded or otherwise rigidly affixed to a lower frame end rail member portion 42*b* being positioned at a foot end of the apparatus 10. Said gear housing 86 provides safe enclosure of internal mechanical components such as, but not limited to: a pinion gear 88 and a ring gear 90. Said gear housing 86 and internal gears 88, 90 provide a means to redirect a torque being applied to the hand crank 82 and attached vertical crank shaft 84, to the horizontal output shaft 92. Furthermore, the pinion 88 and ring 90 gears provide a conventional torque multiplying gear ratio, thereby proportionally reducing a required force to be applied by the caregiver to the hand crank 82. A proximal end of the output shaft 92 extends horizontally from the gear housing 86 through the foot board lower frame end rail member 42*b* along a long centerline of the lower frame assembly 40 being anchored at a distal end to a respective head board lower frame end rail member 42*a* at the head end of the apparatus 10 (see FIG. 3). Said output shaft 92 comprises a pair of integral lift plates 94 being located adjacent to respective lower frame end rail members 42*a*, 42*b* (see FIGS. 6*a* and 6*b*).

Figure 6A:
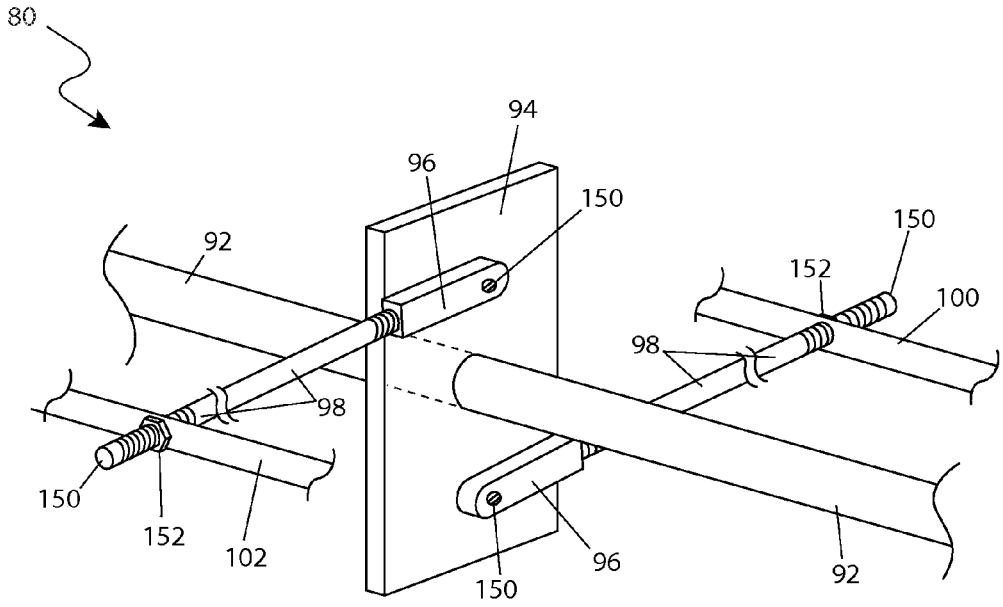
FIG. 6*a* is a perspective view of a lift plate portion 94 of the bed with linen changing means 10 depicting a raised state, according to a preferred embodiment of the present invention.
Figure 6B:
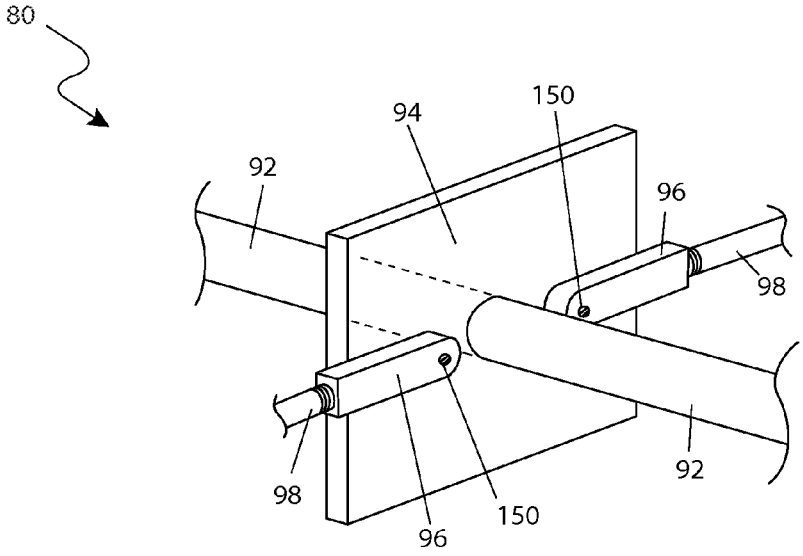
FIG. 6*b* is a perspective view of the lift plate portion 94 of the bed with linen changing means 10 depicting a lowered state, according to a preferred embodiment of the present invention.
Figure 7:
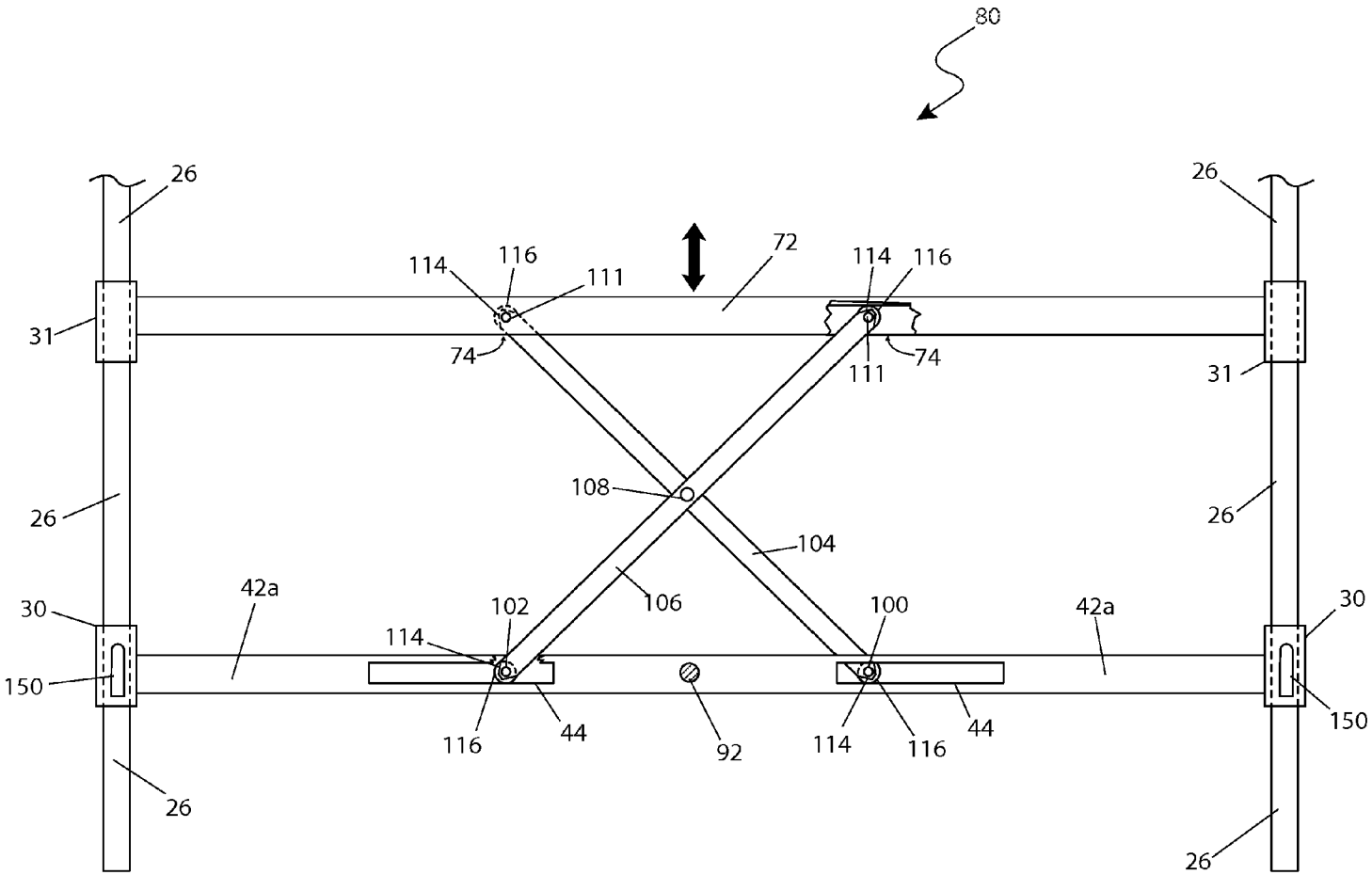
FIG. 7 is a inner side view of a foot board frame assembly portion 24 of the bed with linen changing means 10 depicting lifting mechanism portions 80, according to a preferred embodiment of the present invention.
Figure 8:
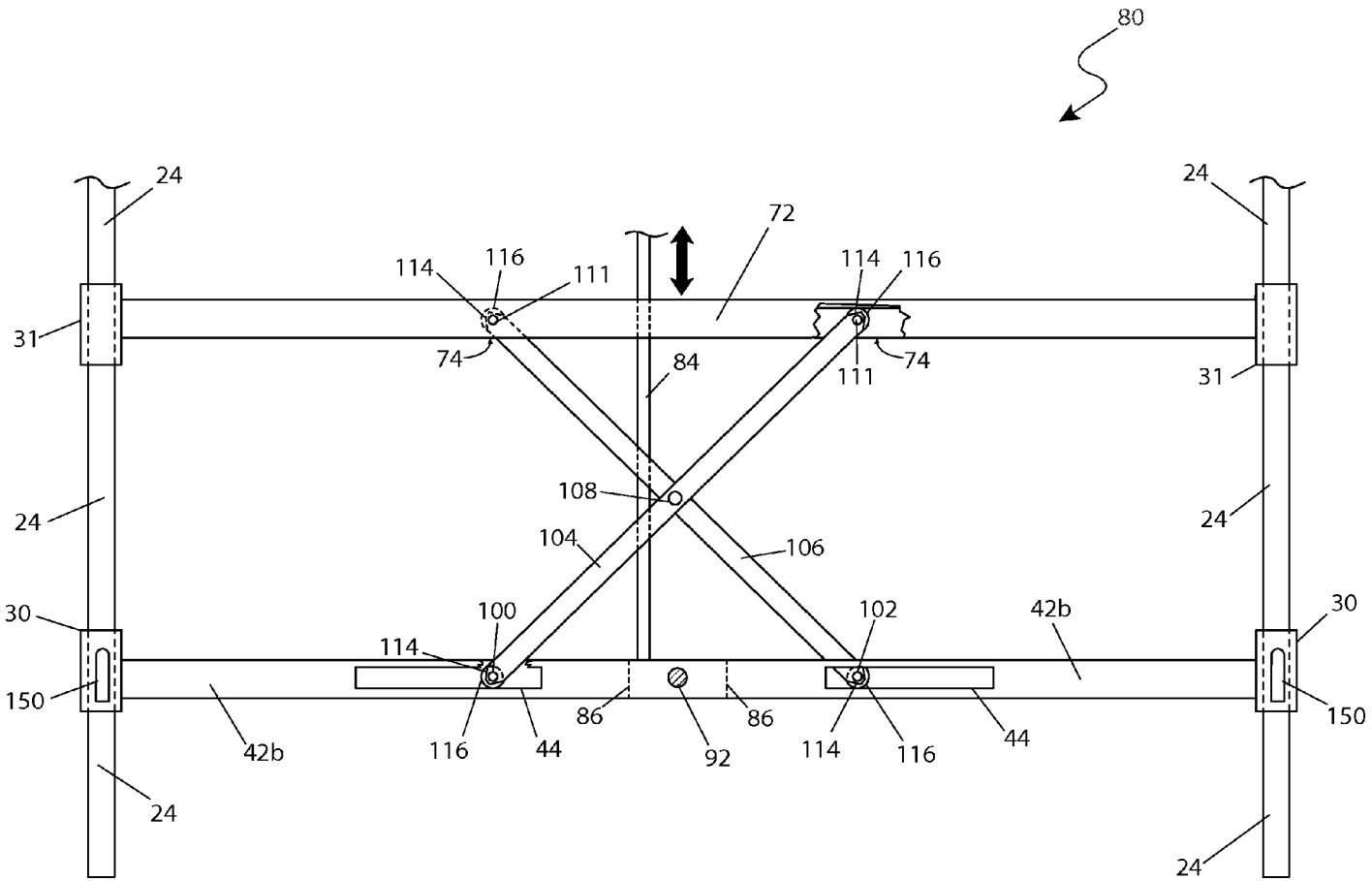
FIG. 8 is a inner side view of a head board frame assembly portion 26 of the bed with linen changing means 10 depicting lifting mechanism portions 80, according to a preferred embodiment of the present invention.

Referring now to FIGS. 6*a* and 6*b*, perspective views of a lift plate portion 94 of the output shaft 92 depicting raised and lowered states, according to a preferred embodiment of the present invention, are disclosed. The apparatus 10 comprises a pair of lift plates 94 being welded or otherwise rigidly attached at a center point being located adjacent to each opposite end portion of the output shaft 92. The output shaft 92 conveys a torsional force to both lift plates 94 which in turn is converted into opposing horizontal linear forces being at right angles to said output shaft 92 via a pair of opposed tie rods 98 being affixed to each lift plate 94. Said tie rods 98 are connected to said lift plates 94 using common threadingly adjustable connecting tie rod end 96 components and common threaded fasteners 150 such as screws or bolts. Said tie rods 98 are in turn in mechanical communication with respective first lifting arm rod 100 and a second lifting arm rod 102 portions via insertion of threaded end portions of said tie rods 98 through said lifting arm rods 100, 102 and are secured using common nut fasteners 152.

Figure 9:
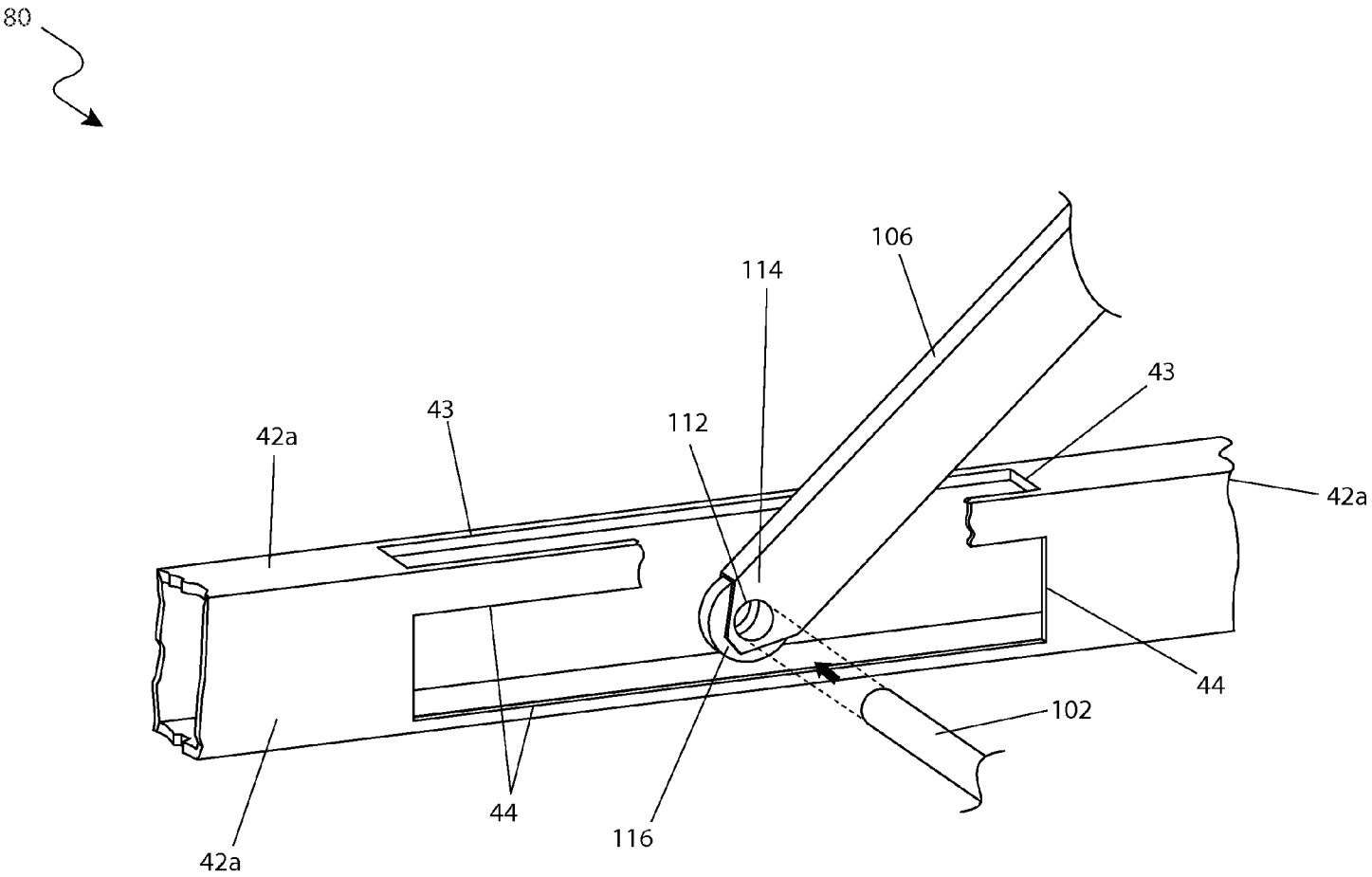
FIG. 9 is a cut-away view of a rolling end portion 114, according to a preferred embodiment of the present invention.
Figure 10:
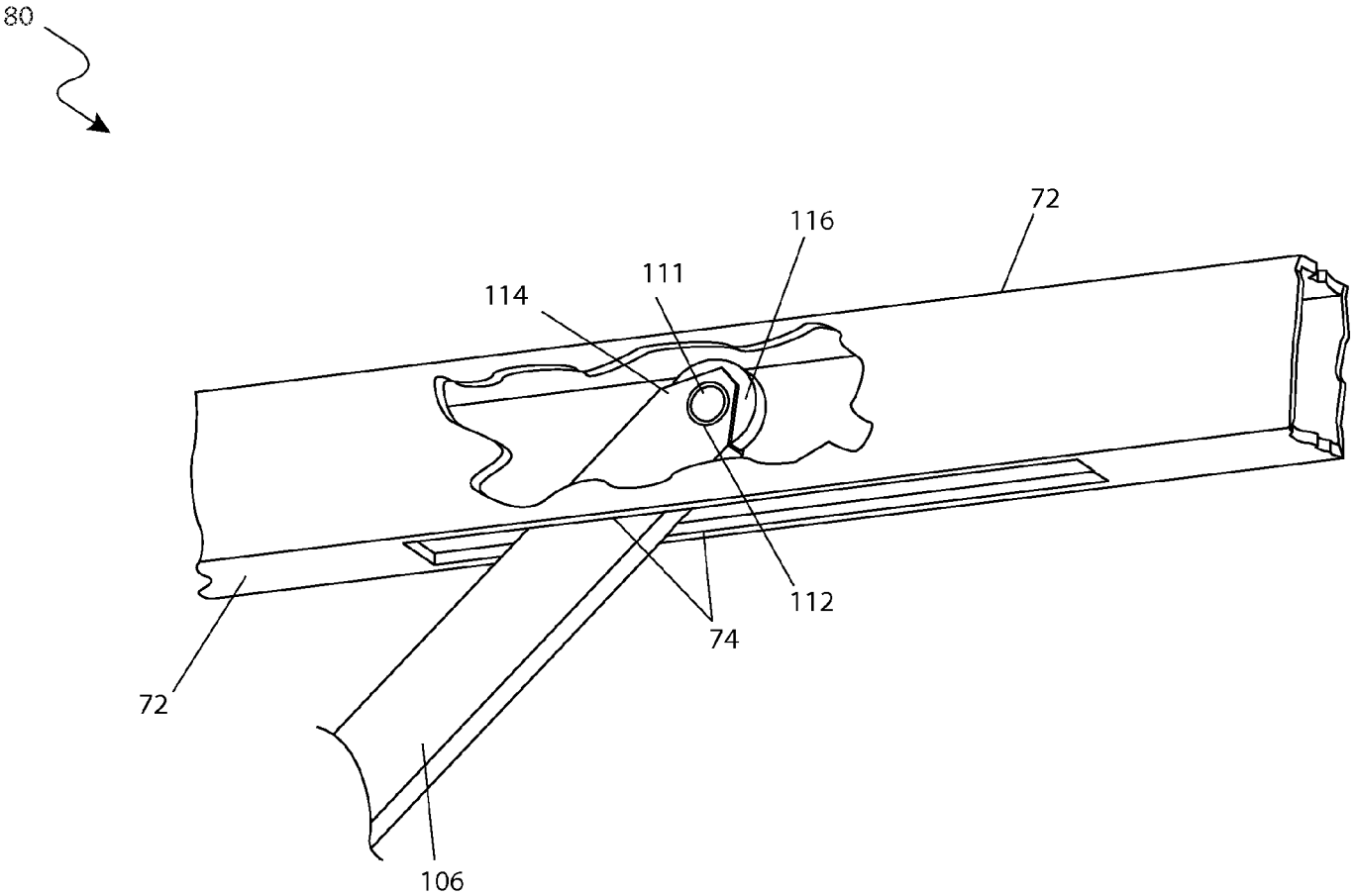
FIG. 10 is another cut-away view of a rolling end portion 114, according to a preferred embodiment of the present invention; and, FIG. 11 is a perspective view of linen 120 and mattress assembly 62 portions, according to a preferred embodiment of the present invention.

Referring now to FIGS. 7, 8, 9, 10, various views of the foot board 24 and head board 26 frame assemblies of the apparatus 10 depicting lifting mechanism portions 80, according to a preferred embodiment of the present invention, are disclosed. The lifting mechanism 80 provides a pair of scissors-type lifting devices at foot and head portions of the apparatus 10. Each scissors-like device comprises first lifting arm 104 and second lifting arm 106 portions being arranged in a diagonal crossing pattern and joined at respective intermediate points using a first pivot pin 108. The operable motioning of the previously described tie rods 98 results in synchronous motioning of said first 100 and second 102 lifting arm rods which are in turn in mechanical communication with the lifting arms 104, 106, as seen in FIG. 9. As the first 100 and second 102 lifting arm rods are motioned toward each other or apart from each other, the lifting mechanism rail 72, which supports the mobile frame support member 70, is correspondingly raised and lowered. Said lifting mechanism rails 72 provide a vertical motioning means via sliding collar portions 31 which are welded to each end portion of said lifting mechanism rails 72. The sliding collars 31 are envisioned to be similar in construction to the aforementioned locking collars 30 and provide a vertical sliding connection to the foot 24 and head 26 frame assemblies, thereby enabling the lifting mechanism rail 72 to motion vertically to lift the mobile frame support member portions 70 of the mobile frame assembly 60, and the mattress assembly 62, during use.

Each first lifting arm 104 and each second lifting arm 106 further comprises a rolling end portion 114 at each end portion. Each lifting arm 104, 106 protrudes downwardly through a first clearance slot feature 43 comprising a rectangular opening cut into a top surface of the lower frame end rail members 42*a*, 42*b* allowing respective rolling end portions 114 of each arm 104, 106 to motion laterally in a guided manner within each said lower frame end rail members 42*a*, 42*b*. In like manner each lifting arm 104, 106 protrudes upwardly through a third clearance slot feature 74 comprising a rectangular opening cut into a bottom surface of a respective lifting mechanism rail 72 allowing said rolling end portions 114 of each arm 104, 106 to motion laterally in a guided manner within said lifting mechanism rails 72.

The rolling end portions 114 located at bottom end portions each lifting arm 104, 106 further comprise axially-mounted cylindrical rollers 116 via inserted first 100 and second 102 lifting arm rods. Said lifting arm rods 100, 102 are inserted through a second clearance slot feature 44 cut along a side surface of each lower frame end rail member 42*a*, 42*b* and in turn subsequently inserted into said rolling end 114 and roller 116 portions, thereby providing a rotating axial function which allows motioning of the rolling end portions 114 toward each other or apart from each other to elevate the lifting mechanism rail 72 and the mobile frame support angle member 70.

Each rolling end portion 114 being located at a top end portion of said lifting arms 104, 106, provides axial attachment of the roller 116 via a second pivot pin 111 being inserted through said rolling end portion 114 and the included roller 116 to allow smooth motioning of said rolling end portions 114 within the lifting mechanism rail 72.

Figure 11:
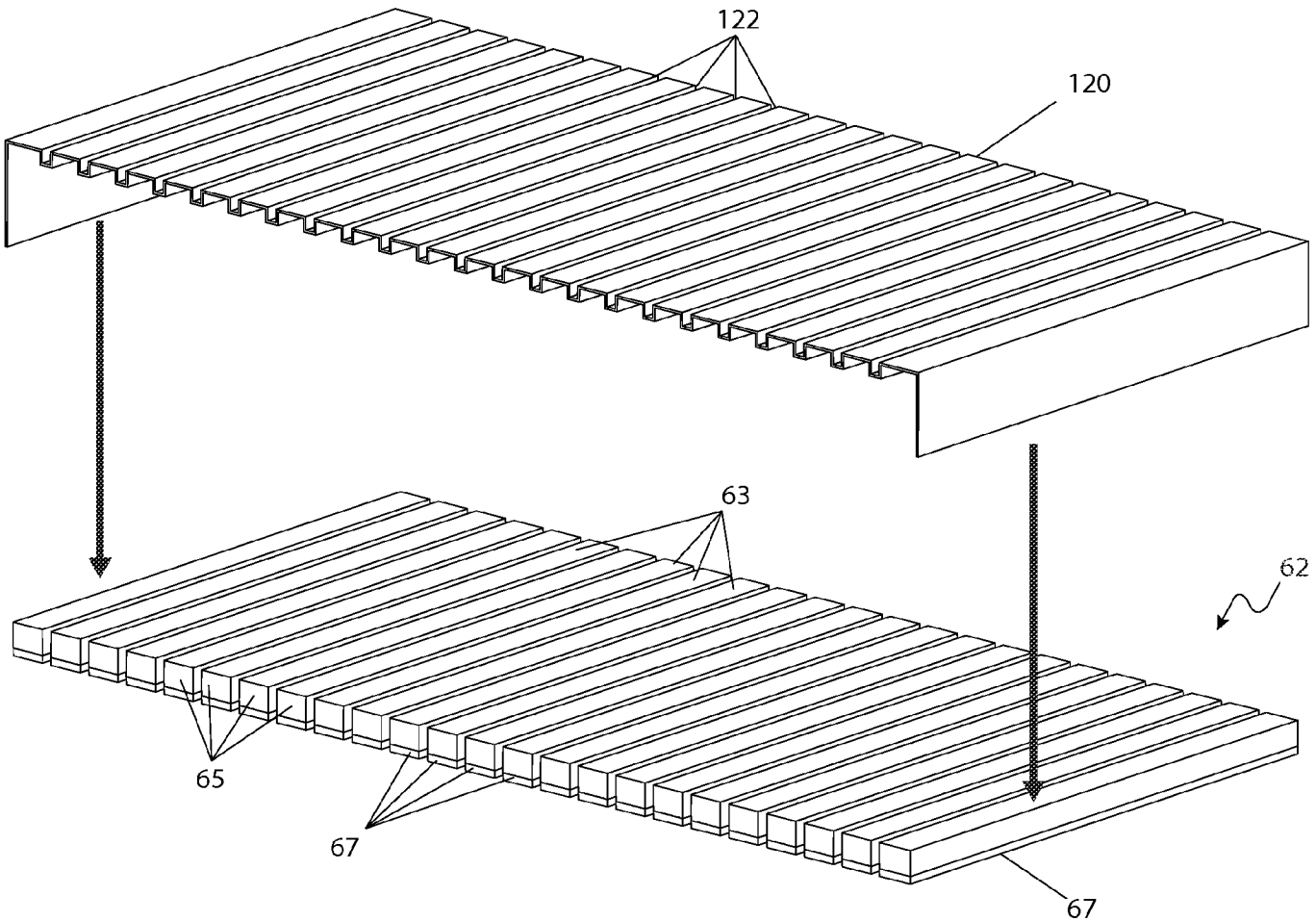

Referring now to FIG. 11, a perspective view of linen 120 and mattress assembly 62 portions, according to a preferred embodiment of the present invention, is disclosed. It is envisioned that the apparatus 10 utilize conventional bed linens 120 having appropriate dimensions which correspond to the apparatus 10 to provide a desired fit.

Each mattress section 63 further comprises an upper mattress padding portion 65 and a lower mattress slat 67 being bonded together using common industrial adhesives. Said mattress padding 65 is envisioned to utilize conventional mattress materials such as cotton batting, foam rubber, natural or synthetic fabric coverings, and the like. Each lower mattress slat 67 supports a respective upper mattress padding 65 which spans a distance between opposing side mobile frame members 64 of the mobile frame assembly 60 (see FIG. 1). Said mattress slats 67 comprise rigid board-like elements envisioned to be made of wood, metal, fiberglass, or equivalent rigid materials and are bonded to said opposing side mobile frame members 64 via adhesive materials, mechanical fasteners, or similar securing techniques.

Said mattress sections 63 are to be arranged in an equally-spaced manner and bonded to top surfaces of said mobile frame members 64 using common industrial adhesives or equivalent fastening means such as screws or the like.

During installation of said linen 120 upon the mattress assembly 62, it is envisioned that the linen 120 be tucked down in between the mattress sections 63 of the mattress assembly 62 to form respective creases 122, thereby providing smooth engagement of said mattress assembly 62 with the support member portions 28 of the upper frame assembly 20 during upward motioning of the mobile frame assembly 60 (see FIGS. 1 through 3).

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be utilized as indicated in FIGS. 1, 2, 3, and 4.

The method of utilizing the apparatus 10 may be achieved by performing the following steps: procuring a model of the apparatus 10 being configured in a desired bed size; applying an initial set of sheet linens 120 to the apparatus 10 by lowering the mobile frame assembly 60 to an elevation below the upper frame assembly 20 by manually turning the hand crank 82; manually extending the mobile frame assembly 60 outwardly to expose the mobile frame assembly 60 and the entire top surface of the mattress assembly 62; covering the mattress assembly 62 with sheet linen 120; tucking the linen 120 in between mattress sections 63 of the mattress assembly 62 to form a plurality of creases 122; returning the mobile frame assembly 60 to an original position beneath the upper frame assembly 20; raising the mobile frame assembly 60 using the hand crank 82 until the mattress sections 63 of the mattress assembly 62 interweave with the support member portions 28 of the upper frame assembly 20; continuing to raise the mattress assembly 62 until top surfaces of the mattress sections 63 and covering linen 120 portions protrude safely above the support members 28; placing an occupant 160 upon the apparatus 10 in a normal manner; and, utilizing the apparatus 10 in a similar manner as a conventional bed unit.

The method of changing bed linens 120 while an occupant 160 is utilizing the apparatus 10 may be achieved by performing the following steps: lowering the mobile frame assembly 60 of the occupied apparatus 10 using the hand crank 82 until the mattress sections 63 are sufficiently below the upper frame assembly 20; allowing the occupant 160 to rest temporarily upon the support member portions 28; manually extending the mobile frame assembly 60 outwardly to expose the used linen 120; removing said used linen 120 in a normal fashion; covering the mattress assembly 62 with a clean sheet linen 120; tucking the clean linen 120 in between mattress section portions 63 of the mattress assembly 62 to form a plurality of creases 122; returning the mobile frame assembly 60 to a position beneath the upper frame assembly 20; raising the mobile frame assembly 60 using the hand crank 82 until the weight of the occupant 160 is lifted off the support members 28 and is resting completely upon the mattress sections 63; utilizing the apparatus 10 in a normal manner until the linen 120 again needs to be changed; repeating the above steps as needed; and, benefiting from a means to change bed linen 120 without disturbing a bed occupant 160 afforded a user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A bed, comprising:

a bed frame structure further comprising an upper frame rail assembly, a lower frame rail assembly, a "U"-shaped foot board assembly affixed to each foot end of said upper frame rail assembly and said lower frame rail assembly, and a "U"-shaped head board assembly affixed to each head end of said upper frame rail assembly and said lower frame rail assembly, wherein:

said upper frame rail assembly further comprises a unitary rectangular structure having a plurality of affixed parallel support members spanning across a top surface in a coplanar fashion between a pair of upper side rail frame members; and said lower frame rail assembly further comprises a unitary rectangular structure generally identical in dimension to said upper frame rail assembly, having a pair of side rail members, a foot board rail member, and a head board rail member;

an adjustable height mechanism for incrementally adjusting said upper frame rail assembly relative to said lower frame rail assembly, further comprising:

a locking collar affixed to each corner area of said upper frame rail assembly and said lower frame rail assembly at an attachment point to each said foot board assembly and said head board assembly; and, a securing fastener for fastening each of said locking collar at a desired position;

a lifting mechanism affixed to said bed frame structure;

a mobile frame assembly adjustably connected to said lifting mechanism and disposed between said upper frame rail assembly and said lower frame rail assembly; and, a mattress assembly supported on said mobile frame assembly;

wherein said lifting mechanism raises and lowers said mattress assembly synchronous with said mobile frame assembly;

wherein an occupant on said bed can be retained on said upper frame rail assembly when said mobile frame assembly is lowered;

wherein said mobile frame assembly is horizontally motioned relative to said bed frame structure; and, wherein bed linen on said mattress assembly can be changed without having an occupant vacate said bed frame structure when said mobile frame assembly is horizontally motioned away from said bed frame structure.

2. The bed of claim 1, wherein said plurality of support members each comprise a rigid rectangular member having a thickness of approximately three-quarters of an inch, a height of approximately three inches, and spaced approximately five inches apart from an adjacent support member.

3. The bed of claim 2, wherein each of said plurality of support members further comprises a rounded top edge.

4. The bed of claim 1, wherein said lifting mechanism further comprises:

a crank shaft securely affixed to said foot board assembly and vertically disposed between an upper end and a lower end;

a hand crank operably connected to said upper end of said crank shaft;

an output shaft having a rear end and a front end anchored to opposing inner surfaces of said foot board rail member and said head board rail member, respectively, said output shaft horizontally disposed between and aligned along a center axis thereof;

a gear housing rigidly affixed to an outer surface of said foot board rail member, further having an upper aperture permitting said crank shaft to extend therein and a side aperture thereby permitting said output shaft to extend therein, said lower end of said crank shaft affixed to a bottom inner surface of said gear housing and said rear end of said output shaft affixed to a rear inner surface of said gear housing;

a pinion gear affixed to said crank shaft adjacent to said lower end and housed within said gear housing;

a ring gear affixed to said output shaft adjacent to said rear end and housed within said gear housing, said ring gear operably connected to said pinion gear;

a rear lifting plate affixed to and operably controlled by said output shaft located adjacent to said foot board rail frame member;

a front lifting plate affixed to and operably controlled by said output shaft located adjacent to said head board rail frame member;

a rear pair of tie rod ends each having a first end fastened to said rear lifting plate on opposing sides of and horizontally aligned with said output shaft;

a rear pair of tie rods each removably fastened to and operably controlled by one of said pair of rear tie rod ends;

a front pair of tie rod ends each having a first end fastened to said front lifting plate on opposing sides of and horizontally aligned with said output shaft;

a front pair of tie rods each removably fastened to and operably controlled by one of said front pair of tie rod ends;

a first lifting arm rod having a front end and a rear end, wherein a second end of one of said pair of rear tie rods and a second end of one of said pair of front tie rods are fastened to said first lifting arm rod, thereby operably controlling said first lifting arm rod;

a second lifting arm rod having a front end and a rear end, wherein a second end of another one of said pair of rear tie rods and a second end of another one of said pair of front tie rods are fastened to said second lifting arm rod, thereby operably controlling said second lifting arm rod;

a rear lifting assembly operably controlled by said rear end of each of said first lifting arm rod and said second lifting arm rod;

a front lifting assembly operably controlled by said front end of each of said first lifting arm rod and said second lifting arm rod;

a rear lifting mechanism rail operably controlled by said rear lifting assembly, said rear lifting mechanism rail spanning between and slidably engaging opposing vertical rail members of said foot board assembly; and, a front lifting mechanism rail operably controlled by said front lifting assembly, said front lifting mechanism rail spanning between and slidably engaging opposing vertical rail members of said head board assembly; and, wherein said ring and pinion gears provides a torque multiplying gear ratio;

wherein rotation of said hand crank translates to rotation of said output shaft via said ring and pinion gears;

wherein said output shaft freely rotates with respect to operation of said hand crank;

wherein rotation of said output shaft synchronously rotates each said rear lifting plate and said front lifting plate;

wherein rotation of said rear lifting plate and said front lifting plate translates to synchronous rotation of said rear pair of tie rods and said front pair of tie rods;

wherein rotation of said rear pair of tie rods and said front pair of tie rods translates to synchronous linear motion of said first lifting arm rod and said second lifting arm rod;

wherein linear motion of said first lifting arm rod and said second lifting arm rod translates into synchronous raising and lowering of said rear lifting assembly and said front lifting assembly wherein rotation of said hand crank in a first direction results in synchronous raising of said rear lifting mechanism rail assembly and said front lifting mechanism rail assembly and said mobile frame assembly, such that said first lifting rod arm and said second lifting rod arm motion said first lifting assembly and said second lifting assembly to travel synchronously toward said output shaft; and, wherein rotation of said hand crank in a second direction results in synchronous lowering of said rear lifting mechanism rail assembly and said front lifting mechanism rail assembly and said mobile frame assembly, such that said lifting rod arm and said second lifting rod arm motion said first lifting assembly and said second lifting assembly to travel synchronously away from said output shaft.

5. The bed of claim 4, wherein:

said rear lifting assembly further comprises:

a scissor type lifting device having a first lifting arm pivotally joined at an intermediate position to an intermediate position of a second lifting arm;

a lower rolling end portion located on each lower end of said first lifting arm and said second lifting arm, said lower rolling end portion each traveling within a respective linear guide within said foot board rail member, said respective linear guide retains said lower rolling end portion therein and further comprises a clearance slot permitting said first lifting arm and said second lifting arm to extend outwardly therefrom; and, an upper rolling end portion located on each upper end of said first lifting arm and said second lifting arm, said upper rolling end portion each traveling within a respective linear guide within said rear lifting mechanism rail, said respective linear guide retains said rolling end portion therein and further comprises a clearance slot permitting said first lifting arm and said second lifting arm to extend outwardly therefrom;

wherein said first lifting arm rod is routed through said foot board rail member to be operably connected to a lower rolling end portion of said first arm; and, wherein said second lifting arm rod is routed through said foot board rail member to be operably connected to a lower rolling end portion of said second arm; and, said front lifting assembly further comprises:

a scissor type lifting device having a first lifting arm pivotally joined at an intermediate position to an intermediate position of a second lifting arm;

a lower rolling end portion located on each lower end of said first lifting arm and said second lifting arm, said lower rolling end portion each traveling within a respective linear guide within said head board rail member, said respective linear guide retains said lower rolling end portion therein and further comprises a clearance slot permitting said first lifting arm and said second lifting arm to extend outwardly therefrom; and, an upper rolling end portion located on each upper end of said first lifting arm and said second lifting arm, said upper rolling end portion each traveling within a respective linear guide within said front lifting mechanism rail, said respective linear guide retains said rolling end portion therein and further comprises a clearance slot permitting said first lifting arm and said second lifting arm to extend outwardly therefrom;

wherein said first lifting arm rod is routed through said head board rail member to be operably connected to a lower rolling end portion of said first arm; and, wherein said second lifting arm rod is routed through said head board rail member to be operably connected to a lower rolling end portion of said second arm.

6. The bed of claim 5, wherein said mobile frame assembly further comprises:

a generally rectangular frame structure having slightly smaller horizontal dimensions with respect to said bed frame structure;

a pair of opposing side rail members;

a pair of mobile frame support members each affixed along a foot end and a head end of each of said pair of opposing side rail members, thereby allowing said mobile frame assembly to slidingly engage each said rear lifting mechanism rail and front lifting mechanism rail;

a pair of downwardly depending leg frame members located on a long side of said frame structure; and, a pair of casters each attached to a bottom end of said pair of leg frame members;

wherein said pair of casters enables said mobile frame assembly to horizontally travel with respect to said bed frame structure.

7. The bed of claim 6, wherein said mattress assembly further comprises a plurality of parallel and equally-spaced mattress sections, each further comprising:

a lower mattress slat spanning a distance between said opposing side rail members;

an upper mattress padding portion bonded to an upper surface of said lower mattress slat;

wherein said plurality of mattress sections allow insertion of each of said plurality of parallel support members of said upper frame rail assembly therein during raising and lowering of said mobile frame assembly.

8. A bed, comprising:

a bed frame structure further comprising an upper frame rail assembly, a lower frame rail assembly, a "U"-shaped foot board assembly affixed to each foot end of said upper frame rail assembly and said lower frame rail assembly, and a "U"-shaped head board assembly affixed to each head end of said upper frame rail assembly and said lower frame rail assembly, wherein:

said upper frame rail assembly further comprises a unitary rectangular structure having a plurality of affixed parallel support members spanning across a top surface in a coplanar fashion between a pair of upper side rail frame members; and said lower frame rail assembly further comprises a unitary rectangular structure generally identical in dimension to said upper frame rail assembly, having a pair of side rail members, a foot board rail member, and a head board rail member;

an adjustable height mechanism for incrementally adjusting said upper frame rail assembly relative to said lower frame rail assembly, further comprising:

a locking collar affixed to each corner area of said upper frame rail assembly and said lower frame rail assembly at an attachment point to each said foot board assembly and said head board assembly; and, a securing fastener for fastening each of said locking collar at a desired position;

a lifting mechanism affixed to said bed frame structure;

a mobile frame assembly adjustably connected to said lifting mechanism and disposed between said upper frame rail assembly and said lower frame rail assembly; and a mattress assembly supported on said mobile frame assembly;

wherein said lifting mechanism raises and lowers said mattress assembly concurrent with said mobile frame assembly;

wherein an occupant on said bed can be retained on said upper frame rail assembly when said mobile frame assembly is lowered;

wherein said upper frame assembly is adapted to have at least one restraint located thereon to secure said occupant to said upper frame rail assembly;

wherein said mobile frame assembly is horizontally motioned relative to said bed frame structure; and, wherein bed linen on said mattress assembly can be changed without having an occupant vacate said bed frame structure when said mobile frame assembly is horizontally motioned away from said bed frame structure.

9. The bed of claim 8, wherein said plurality of support members each comprise a rigid rectangular member having a thickness of approximately three-quarters of an inch, a height of approximately three inches, and spaced approximately five inches apart from an adjacent support member.

10. The bed of claim 9, wherein each of said plurality of support members further comprises a rounded top edge.

11. The bed of claim 8, wherein said lifting mechanism further comprises:

a crank shaft securely affixed to said foot board assembly and vertically disposed between an upper end and a lower end;

a hand crank operably connected to said upper end of said crank shaft;

an output shaft having a rear end and a front end anchored to opposing inner surfaces of said foot board rail member and said head board rail member, respectively, said output shaft horizontally disposed between and aligned along a center axis thereof;

a gear housing rigidly affixed to an outer surface of said foot board rail member, further having an upper aperture permitting said crank shaft to extend therein and a side aperture thereby permitting said output shaft to extend therein, said lower end of said crank shaft affixed to a bottom inner surface of said gear housing and said rear end of said output shaft affixed to a rear inner surface of said gear housing;

a pinion gear affixed to said crank shaft adjacent to said lower end and housed within said gear housing;

a ring gear affixed to said output shaft adjacent to said rear end and housed within said gear housing, said ring gear operably connected to said pinion gear;

a rear lifting plate affixed to and operably controlled by said output shaft located adjacent to said foot board rail frame member;

a front lifting plate affixed to and operably controlled by said output shaft located adjacent to said head board rail frame member;

a rear pair of tie rod ends each having a first end fastened to said rear lifting plate on opposing sides of and horizontally aligned with said output shaft;

a rear pair of tie rods each removably fastened to and operably controlled by one of said pair of rear tie rod ends;

a front pair of tie rod ends each having a first end fastened to said front lifting plate on opposing sides of and horizontally aligned with said output shaft;

a front pair of tie rods each removably fastened to and operably controlled by one of said front pair of tie rod ends;

a first lifting arm rod having a front end and a rear end, wherein a second end of one of said pair of rear tie rods and a second end of one of said pair of front tie rods are fastened to said first lifting arm rod, thereby operably controlling said first lifting arm rod;

a second lifting arm rod having a front end and a rear end, wherein a second end of another one of said pair of rear tie rods and a second end of another one of said pair of front tie rods are fastened to said second lifting arm rod, thereby operably controlling said second lifting arm rod;

a rear lifting assembly operably controlled by said rear end of each of said first lifting arm rod and said second lifting arm rod;

a front lifting assembly operably controlled by said front end of each of said first lifting arm rod and said second lifting arm rod;

a rear lifting mechanism rail operably controlled by said rear lifting assembly, said rear lifting mechanism rail spanning between and slidably engaging opposing vertical rail members of said foot board assembly; and, a front lifting mechanism rail operably controlled by said front lifting assembly, said front lifting mechanism rail spanning between and slidably engaging opposing vertical rail members of said head board assembly; and, wherein said ring and pinion gears provides a torque multiplying gear ratio;

wherein rotation of said hand crank translates to rotation of said output shaft via said ring and pinion gears;

wherein said output shaft freely rotates with respect to operation of said hand crank;

wherein rotation of said output shaft synchronously rotates each said rear lifting plate and said front lifting plate;

wherein rotation of said rear lifting plate and said front lifting plate translates to synchronous rotation of said rear pair of tie rods and said front pair of tie rods;

wherein rotation of said rear pair of tie rods and said front pair of tie rods translates to synchronous linear motion of said first lifting arm rod and said second lifting arm rod;

wherein linear motion of said first lifting arm rod and said second lifting arm rod translates into synchronous raising and lowering of said rear lifting assembly and said front lifting assembly wherein rotation of said hand crank in a first direction results in synchronous raising of said rear lifting mechanism rail assembly and said front lifting mechanism rail assembly and said mobile frame assembly, such that said first lifting rod arm and said second lifting rod arm motion said first lifting assembly and said second lifting assembly to travel synchronously toward said output shaft; and, wherein rotation of said hand crank in a second direction results in synchronous lowering of said rear lifting mechanism rail assembly and said front lifting mechanism rail assembly and said mobile frame assembly, such that said lifting rod arm and said second lifting rod arm motion said first lifting assembly and said second lifting assembly to travel synchronously away from said output shaft.

12. The bed of claim 11, wherein:

said rear lifting assembly further comprises:

a scissor type lifting device having a first lifting arm pivotally joined at an intermediate position to an intermediate position of a second lifting arm;

a lower rolling end portion located on each lower end of said first lifting arm and said second lifting arm, said lower rolling end portion each traveling within a respective linear guide within said foot board rail member, said respective linear guide retains said lower rolling end portion therein and further comprises a clearance slot permitting said first lifting arm and said second lifting arm to extend outwardly therefrom; and, an upper rolling end portion located on each upper end of said first lifting arm and said second lifting arm, said upper rolling end portion each traveling within a respective linear guide within said rear lifting mechanism rail, said respective linear guide retains said rolling end portion therein and further comprises a clearance slot permitting said first lifting arm and said second lifting arm to extend outwardly therefrom;

wherein said first lifting arm rod is routed through said foot board rail member to be operably connected to a lower rolling end portion of said first arm; and, wherein said second lifting arm rod is routed through said foot board rail member to be operably connected to a lower rolling end portion of said second arm; and, said front lifting assembly further comprises:

a scissor type lifting device having a first lifting arm pivotally joined at an intermediate position to an intermediate position of a second lifting arm;

a lower rolling end portion located on each lower end of said first lifting arm and said second lifting arm, said lower rolling end portion each traveling within a respective linear guide within said head board rail member, said respective linear guide retains said lower rolling end portion therein and further comprises a clearance slot permitting said first lifting arm and said second lifting arm to extend outwardly therefrom; and, an upper rolling end portion located on each upper end of said first lifting arm and said second lifting arm, said upper rolling end portion each traveling within a respective linear guide within said front lifting mechanism rail, said respective linear guide retains said rolling end portion therein and further comprises a clearance slot permitting said first lifting arm and said second lifting arm to extend outwardly therefrom;

wherein said first lifting arm rod is routed through said head board rail member to be operably connected to a lower rolling end portion of said first arm; and, wherein said second lifting arm rod is routed through said head board rail member to be operably connected to a lower rolling end portion of said second arm.

13. The bed of claim 12, wherein said mobile frame assembly further comprises:

a generally rectangular frame structure having slightly smaller horizontal dimensions with respect to said bed frame structure;

a pair of opposing side rail members;

a pair of mobile frame support members each affixed along a foot end and a head end of each of said pair of opposing side rail members, thereby allowing said mobile frame assembly to slidingly engage each said rear lifting mechanism rail and front lifting mechanism rail;

a pair of downwardly depending leg frame members located on a long side of said frame structure; and, a pair of casters each attached to a bottom end of said pair of leg frame members;

wherein said pair of casters enables said mobile frame assembly to horizontally travel with respect to said bed frame structure.

14. The bed of claim 13, wherein said mattress assembly further comprises a plurality of parallel and equally-spaced mattress sections, each further comprising:

a lower mattress slat spanning a distance between said opposing side rail members;

an upper mattress padding portion bonded to an upper surface of said lower mattress slat;

wherein said plurality of mattress sections allow insertion of each of said plurality of parallel support members of said upper frame rail assembly therein during raising and lowering of said mobile frame assembly.

* * * * *